US005240075A

United States Patent [19]

Burrows et al.

[11] Patent Number: 5,240,075

[45] Date of Patent: Aug. 31, 1993

[54] PROTECTION OF GRAVEL PACK WELL COMPLETIONS DURING STEAM INJECTION

[75] Inventors: Darryl N. Burrows; Paul S. Northrop, both of Carrollton, Tex.

[73] Assignee: Mobil Oil Corporation, Fairfax, Va.

[21] Appl. No.: 837,137

[22] Filed: Feb. 19, 1992

[51] Int. Cl.[5] ..... E21B 43/04

[52] U.S. Cl. ..... 166/303

[58] Field of Search ..... 122/459; 166/303; 423/335, 340, 659, DIG. 19

[56] References Cited

U.S. PATENT DOCUMENTS

| | | | |
|---|---|---|---|
| 3,438,443 | 4/1969 | Pratz et al. | 166/303 |
| 4,323,124 | 4/1982 | Swan | 166/303 |
| 4,328,106 | 5/1982 | Harrar et al. | 423/DIG. 19 |
| 4,475,595 | 10/1984 | Watkins et al. | 166/303 |
| 4,913,236 | 4/1990 | Reed | 166/302 X |
| 5,145,656 | 9/1992 | Gallup et al. | 423/DIG. 19 |

*Primary Examiner*—William P. Neuder

*Attorney, Agent, or Firm*—Alexander J. McKillop; George W. Hager, Jr.

[57] ABSTRACT

A method and apparatus for treating steam which is to be injected into a formation through a gravel pack well completion by preventing dissolution and removal of silica from the gravel pack. The steam is flowed through a treatment vessel which is filled with a silica-containing material, e.g. sand, where it dissolves silica from the sand prior to injection through the gravel pack. Since the treated steam is already substantially saturated with silica, it will not dissolve any substantial amounts of silica from the gravel pack. The treatment vessel can also be heated during treatment, if desired.

6 Claims, 1 Drawing Sheet

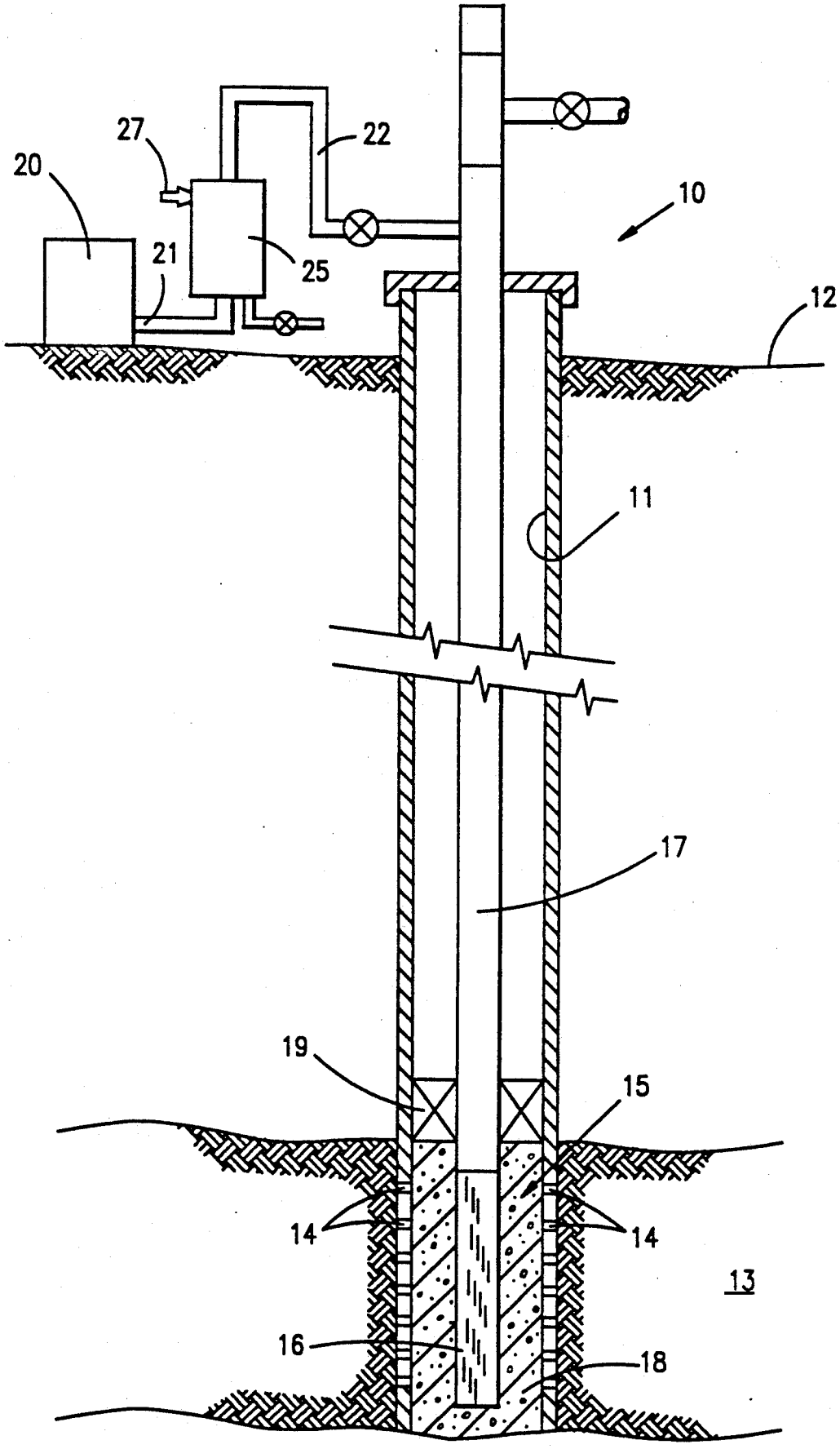
27
22
20
10
21
25
12
11
17
19
15
14
14
13
16
18

PROTECTION OF GRAVEL PACK WELL COMPLETIONS DURING STEAM INJECTION

DESCRIPTION

1. Technical Field

The present invention relates to the protection of gravel pack well completions used for steam injection in secondary recovery operations and in one of its aspects relates to a method and apparatus for treating steam before it is injected into a formation through a gravel pack well completion so as to prevent the steam from damaging the integrity of the gravel pack.

2. Background Art

There are substantial deposits of heavy hydrocarbons (hereinafter collectively called "heavy oil") throughout the world which have such a high viscosity that they can not be produced by primary recovery techniques. To produce these deposits, it is common to use thermal techniques which heat the heavy oil in place to reduce its viscosity to a level sufficient to allow it to flow from the formation into the well. One of the best known and most commonly used of such thermal processes is commonly referred to as "steam stimulation" and involves injecting steam down the well and into the formation to heat the heavy oil. The injected steam also increases the pressure in the formation which, in turn, aids in producing the heated, heavy oil from the formation.

Unfortunately, many of these heavy oil reservoirs are contained in loosely consolidated or unconsolidated and/or fractured subterranean formations. As is well known in the art, it is not uncommon to produce large volumes of particulate material (e.g. sand) from these types of reservoirs along with the formation fluids. This produced sand routinely causes a variety of problems which result in added expense and substantial downtime, e.g. the produced sand may cause severe erosion of the well tubing and other production equipment; partial or complete clogging of the flow from the well; caving of the formation and/or collapse of the well casing; etc. Accordingly, it is very important to control the production of sand during a recovery operation.

One of the most widely-used techniques for controlling sand production from a well is one which is commonly known as "gravel packing". In a typical gravel pack completion, a screen or the like is positioned within the wellbore adjacent the interval of the well which is to be completed and the annulus around the screen is filled with particulate material (i.e. sand, gravel, etc., collectively referred herein as "gravel"). The gravel is sized to form a permeable mass around the screen which allows flow of fluids therethrough while effectively blocking the flow produced sand.

For a gravel pack to function effectively over an extended operational life, the mass of gravel in the annulus around the screen must maintain an adequate compactness during the flow of fluids therethrough. Unfortunately, when steam is injected through a gravel pack completion, the mass of gravel around the screen begins to lose its compactness and hence, its effectiveness. It appears that the hot steam, which is also strongly basic, contacts and dissolves silica from the compacted gravel around the screen and carries the dissolved silica out of the gravel mass and into the formation.

As silica from the gravel is dissolved and carried away by the steam, the gravel mass surrounding the screen becomes more and more permeable to flow of produced sand thereby losing its effectiveness in straining the produced sand from the fluids. Accordingly, there is a real need to protect a gravel pack from this silica dissolution to improve its effective operational life during steam injection.

One proposed method for combating silica dissolution in a gravel pack completion has been to use "garnet" sand to form the gravel mass around the screen. These particles of garnet better resist the detrimental effect of the steam but the cost of such material makes its use impractical in most application. The present invention provides a much simpler and less expensive solution to this problem.

SUMMARY OF THE INVENTION

The present invention provides a method and apparatus for treating steam which is to be injected into a formation through a gravel pack well completion. The treatment of the steam aids in preventing dissolution and removal of silica from the gravel pack to thereby substantially extend the operational life of the gravel pack completion during the steam injection.

More specifically, in accordance with the present invention, a treatment vessel is positioned at or near the outlet of the boiler which generates the steam to be injected through a gravel pack well completion. The vessel is filled with a silica-containing material such as sand or the like particulate material. The sand used in treatment vessel may be the same or similar silica-containing, particulate material that is actually used as the "gravel" in gravel pack well completion.

Steam is generated in boiler and is flowed from the outlet of the boiler through the silica-containing sand in treatment vessel. The steam contacts the sand and dissolves silica therefrom in the same manner as the steam would otherwise dissolve silica from the gravel in the gravel pack completion. The treated steam flows from the vessel and down the well where it is injected through the gravel pack completion into a desired formation. Since the dissolved silica from sand in the vessel has already substantially "saturated" the liquid phase of the steam, the steam will not dissolve any further substantial amounts of silica from the gravel pack in the well as the steam is injected therethrough. Accordingly, the treated steam will have little, if any, adverse affect on the operational life of the gravel pack completion during the injection of the steam.

Further, external heat can be applied to the treatment vessel during treatment, if necessary, to maintain desired injection temperature of the steam for injection.

BRIEF DESCRIPTION OF THE DRAWINGS

The actual construction, operation, and apparent advantages of the present invention will be better understood by referring to the drawings in which like numerals identify like parts and in which:

The FIGURE is an elevational view, partly in section, of a typical gravel-packed well used for steam injection with which the present invention is utilized.

BEST KNOWN MODE FOR CARRYING OUT THE INVENTION

Referring more particularly to the drawings, the FIGURE illustrates a gravel-packed well 10 as used for injection of steam during a steam stimulation or like operation. Well 10 has a wellbore 11 which extends from the surface 12 through an unconsolidated and/or fractured formation 13 of the type which contains heavy hydrocarbons, e.g. heavy oil. As known, heavy oil has a viscosity high enough to prevent it from flowing from the formation under normal conditions. Wellbore 11 may be cased and provided with perforations 14 adjacent formation 13, as shown, or the wellbore may be "open-hole" adjacent formation 13 as will be clearly understood in the art.

Gravel pack completion 15 is installed within wellbore 11 adjacent formation 13 and is comprised of a screen 16 or the like which is suspended from the lower end of injection/production tubing 17. The annulus around screen 16 between the screen and the wellbore 11 is filled with a silica-containing, particulate material 18 (e.g. gravel, sand, etc., collectively called "gravel"). The openings in the screen 16 and the gravel 18 are sized to allow the flow of fluids therethrough while effectively blocking the flow of particulate material such as produced sand and the like. Gravel pack completions are installed in a variety of ways which are well known in the art.

As is well known in the art, steam stimulation can be carried out as either a "steam drive" or as a cyclic, "huff and puff" process. In a steam drive, the steam is injected in an injection well and flows through the formation to a separate production well which is spaced from the injection well. The steam heats and drives the heavy oil and other formation fluids towards the production well as it moves through the formation.

In a huff and puff operation, the same well is used as both the injection and production well. A desired volume of steam is injected into the formation through the well. The well is then usually shut in for a desired period during which time the injected steam "soaks" and heats the formation and the fluids therein. The well is then opened and the pressure within the formation forces the heavy oil and other formation fluids back into the well through which they are produced to the surface. This "huff and puff" cycle is usually repeated until production declines below a commercial level.

As illustrated, well 10 is well which is used as both the injection well and the production well in a "huff and puff" steam stimulation recovery process. However, it should be recognized that well 10 could also equally represent either an injection well or a separate production well of the types used in "steam drive" stimulation recovery operations.

In typical steam stimulation processes, the necessary steam is routinely generated at or near the injection site using feed water(s) which are readily available at the site. Typically, the feed waters may include previously produced formation waters, certain ground waters, etc., most of which normally contain relatively high concentrations of bicarbonates. When an acceptable quality of steam (e.g. 70% quality) is generated using such waters, carbon dioxide evolves off into the gas phase of the steam while the remaining carbonates become concentrated in the liquid phase of the steam. It is believed that when this hot (e.g. from about 150° to about 200° C.) and highly basic (e.g. from about 10 to about 12 pH) liquid phase of the steam contacts silica, which makes up a large part of the gravel 18, it begins to dissolve the silica. This silica dissolves into the liquid phase of the steam and is carried thereby out of the gravel pack 15 and into formation 13. As steam injection continues, additional silica is dissolved and removed from the gravel 18. This substantially increases the permeability of the gravel mass 18 surrounding the screen 16 which, in turn, adversely affects the effectiveness and efficiency of the gravel pack completion.

In accordance with the present invention, the steam is treated at the surface before it is injected through the gravel pack well completion. Referring again to the FIGURE, a treatment chamber or vessel 25 or the like having an inlet fluidly connected to the outlet of boiler 20 by conduit 21. Vessel 25 is filled with a silica-containing particulate material (collectively referred to herein as "sand"). In some instances, the sand used in vessel 25 may be the same or similar to that which is used to form the mass of gravel 18 in gravel pack completion 15.

Steam is generated in boiler 20 and flows through conduit 21 into vessel 25. It is believed that the hot and strongly basic liquid phase of the steam (e.g. 70% quality steam) contacts the silica in the sand in vessel 25 as the steam flows therethrough and dissolves some of the silica in the same manner as untreated steam would dissolve silica in the gravel pack 15. The treated steam, with its liquid phase now substantially "saturated" with silica, flows from the outlet of vessel 25, through outlet 22, and down tubing 17 for injection into formation 13 through the gravel pack completion 15. Since the liquid phase of the steam is already "saturated" with silica from the sand in vessel 25, it will not dissolve any further substantial amounts of silica as it passes through gravel 18 in the wellbore. Accordingly, gravel pack 15 will be virtually uneffected by the steam injection and the operational life thereof will be substantially extended.

If desired, external heat (steam jacket, electric coils, direct flame, etc., represented by arrow 27 in the FIGURE) can be applied to vessel 25 to maintain the steam at a desired injection temperature. Also, a drain 28 can be provided on vessel 25 to drain condensed liquids if so desired.

What is claimed is:

1. A method for protecting a gravel pack completion in a well through which steam is injected into a subterranean formation wherein gravel used to form said gravel pack completion contains silica; said method comprising:

passing said steam through a silica-containing particulate material at the surface prior to injecting said steam through said gravel pack well completion.

2. The method of claim 1 wherein said silica-containing material is substantially the same material as said gravel.

3. A method for protecting a gravel pack completion in a well through which steam is injected into a subterranean formation wherein gravel used to form said gravel pack completion contains silica; said method comprising:

connecting a treatment vessel to the outlet of a boiler used to generate said steam;

filling said treatment vessel with a silica-containing particulate material;

passing said steam through said treatment vessel and in contact with said silica-containing particulate material to dissolve silica into said steam prior to injecting said steam through said gravel pack well completion.

4. The method of claim 3 wherein said silica-containing material is substantially the same material as said gravel.

5. The method of claim 3 wherein said silica-containing particulate material comprises sand.

6. The method of claim 3 including:

heating said silica-containing particulate material while said steam is passing therethrough.

* * * * *